US005792037A

United States Patent [19]

Bodelson et al.

[11] Patent Number: 5,792,037

[45] Date of Patent: Aug. 11, 1998

[54] CENTRIFUGAL ROTOR AND A SLIDE FOR SUCH A ROTOR

[75] Inventors: Berth Bodelson, Tullinge; Kjell Klintenstedt, Saltsjö-Boo; Toini Salmi, Sorunda; Nils-Gunnar Ohlson, Nacka; Jan Setterberg, Huddinge; Staffan Holm, Rönninge, all of Sweden

[73] Assignee: Alfa Laval AB, Lund, Sweden

[21] Appl. No.: 776,042

[22] PCT Filed: May 24, 1996

[86] PCT No.: PCT/SE96/00672

§ 371 Date: Apr. 10, 1997

§ 102(e) Date: Apr. 10, 1997

[87] PCT Pub. No.: WO96/41683

PCT Pub. Date: Dec. 27, 1996

[30] Foreign Application Priority Data

Jun. 8, 1995 [SE] Sweden ..... 9502098

[51] Int. Cl.[6] ..... B04B 1/14; B04B 1/18

[52] U.S. Cl. ..... 494/40; 494/70

[58] Field of Search ..... 494/2–4, 23, 27–30, 494/40, 47, 48, 56, 68, 70, 85

[56] References Cited

U.S. PATENT DOCUMENTS

| | | | |
|---|---|---|---|
| 3,193,194 | 7/1965 | Steinacker | 494/40 |
| 3,765,599 | 10/1973 | Hemfort | 494/40 |
| 4,151,951 | 5/1979 | Kohlstette | 494/40 |
| 4,505,698 | 3/1985 | Broker | 494/40 |
| 4,813,923 | 3/1989 | Johansson | 494/40 X |

FOREIGN PATENT DOCUMENTS

| | | | |
|---|---|---|---|
| 3109346 | 11/1982 | Germany | 494/2 |

*Primary Examiner*—Charles E. Cooley
*Attorney, Agent, or Firm*—Fish & Richardson P.C.

[57] ABSTRACT

In the rotor of a centrifugal separator there is an annular slide (6) for opening and closing of a periphery outlet (12, 13) from a separation chamber (9). The slide (6) at its radially inner edge is connected with and axially fixed relative to the rotor body (1, 2) but has a radially outer edge portion (11) which is axially movable relative to the rotor body (1, 2). This is possible because a portion of the slide, having a substantial radial extension, is flexible. In operation, the flexibility of the slide results in an angular change between portions of the slide situated at different radial distances from the center axis of the rotor.

9 Claims, 2 Drawing Sheets

CENTRIFUGAL ROTOR AND A SLIDE FOR SUCH A ROTOR

FIELD OF THE INVENTION

The invention relates to a centrifugal rotor and a slide for such a rotor.

BACKGROUND OF THE INVENTION

A centrifugal separator comprising a rotor body, which is rotatable around a centre axis, often has at least one annular slide which is arranged coaxially with the rotor body and is axially movable relative thereto during rotation of the rotor. A slide of this kind, which is comparatively thick and stiff in order not to be deformed when it is subjected to large both radial and axial forces, is as a rule adapted for opening and closing of certain passages in the rotor body, e.g. outlet passages from a separation chamber or flow passages for a so called operating liquid. As a rule the slide is axially movable in a hydraulic or pneumatic way but can alternatively or additionally be influenced by mechanical springs of one kind or another.

The radial guiding of the slide during its axial movements takes place as a rule in a way such that the radially inner edge portion of the slide with an insignificant play surrounds and is guided by a central cylindrical part of the rotor body. In order to avoid that the slide causes unbalance of the rotor during its rotation it is strived at having a play as small as possible between the slide and said part of the rotor body.

A problem in this connection is that the slide during its axial movement in the rotor is sometimes subjected to forces which tend to cause the slide to be inclined in relation to the centre axis of the rotor body. This leads to abutment between the slide and said central part of the rotor body, so that friction forces come up. These can be so large that they cause damage to the slide and/or the rotor body.

Different solutions to this problem have been proposed in U.S. Pat. No. 4,505,698 in connection with an annular slide that is adapted for opening and closing of peripheral outlets from a separation chamber of a centrifugal rotor. According to a first design proposal presented in U.S. Pat. No. 4,505,698 (FIGS. 1 and 2) the annular slide should be formed in one single piece and have a centre part and a circumferential part. The centre part should be in the form of an axially expandable sleeve, which at one of its ends is axially and radially fixed relative to the centrifugal rotor and at its other end supports said circumferential part of the slide. A separate radial guiding of the circumferential slide part or said other end of the sleeve formed centre part is said not to be necessary, as the sleeve formed centre part should be sufficiently stiff to take up radial forces which may influence the circumferential part of the slide during operation of the centrifugal rotor.

According to a second design proposal presented in U.S. Pat. No. 4,505,698 (FIGS. 3 and 4) the annular slide should be adapted to be centered by a separate member which simultaneously constitutes a spring for axial actuation of the slide.

According to a third design proposal presented in U.S. Pat. No. 4,505,698 (FIG. 5) the annular slide by its radially inner edge portion should be connected with the rotor body through an annular rubber sleeve, which has a relatively small axial spring constant but a relatively large radial spring constant. Hereby, it is said, the slide could be given a required axial movability and a very limited radial movability.

Said first design proposal is believed to be difficult to realize, since weakening of the sleeve formed centre part of the slide in order to enable an axial movement of the circumferential part of the slide is difficult to accomplish without giving the circumferential part of the slide an undesired possibility of also moving radially as a consequence of radial forces coming up due to the imbalance of the rotor during its operation. Such unbalanced forces are normally very large. The same problem in connection with the imbalance of the centrifugal rotor can be forseen in connection with said third design proposal which, like said second design proposal, resides in the use of a separate member for centering of the slide.

SUMMARY OF THE INVENTION

The object of the present invention is to provide a slide for the rotor of a centrifugal separator, which is cheap to manufacture and which, like the slide according to the above mentioned first design proposal (FIG. 1 in U.S. Pat. No. 4,505,698) is formed in one single piece and has a centre part and a circumferential part movable axially in relation thereto, but which slide is formed in a way such that it can resist substantial forces striving to move the circumferential part radially in relation to the centre part during operation of the centrifugal rotor.

This object can be obtained according to the invention by a slide, which comprises a centre part and a circumferential part surrounding the centre part and being formed in one single piece with and of the same material as the centre part and which slide is formed for being mounted in a rotor of a centrifugal separator for rotation therewith having its said circumferential part extending around a centre axis coinciding with the rotational axis of the rotor, at least an annular portion of said circumferential part of the slide being axially movable from a first position to a second position relative to at least a portion of said centre part upon resilient deformation of the slide in an annular area concentrical with said centre axis, the slide being characterized in that said annular area has a radial extension such that, upon said resilient deformation of the slide, an angular change will come up—seen in an axial section through the slide—between portions of the slide situated at different distances from said centre axis.

A slide formed in this way may be made relatively thin and flexible along a substantial part of its radial extension, seen in said axial section through the slide. This means that the slide requires a minimum space in the rotor, seen in the axial direction, and can be given a relatively small weight. With a slide formed according to the invention a desired axial movability can be accomplished without difficulty between concentrical portions of the slide without risk for radial movements coming up between these portions as a consequence of unbalanced forces, which may influence the slide when it is used in a centrifugal rotor.

The slide according to the invention may be formed either as a full disc or be annular, i.e. have a central hole surrounded by a radial inner edge portion of the slide.

The invention also concerns a centrifugal rotor comprising a rotor body, which has a centre axis, around which it is rotatable, and a slide of the above defined kind mounted for rotation with the rotor body with its circumferential portion extending around said centre axis.

In a centrifugal rotor of this kind a slide, if it is annular, can be connected with a central part of the rotor body in different ways. Either the radially inner edge portion of the slide may be just axially fixed relative to the rotor body but be allowed to form different angles with the centre axis of the rotor body, or the same edge portion may be fixedly clamped in the rotor body along part of its radial extension, so that it can not be inclined relative to the centre axis. The different alternatives for the connection of the slide with the rotor body give different pre-requisites for the deformation of the slide in the above mentioned annular area.

BRIEF DESCRIPTION OF THE DRAWINGS

The invention is described in the following with reference to the accompanying drawings, in which.

DETAILED DESCRIPTION

Figure 1:
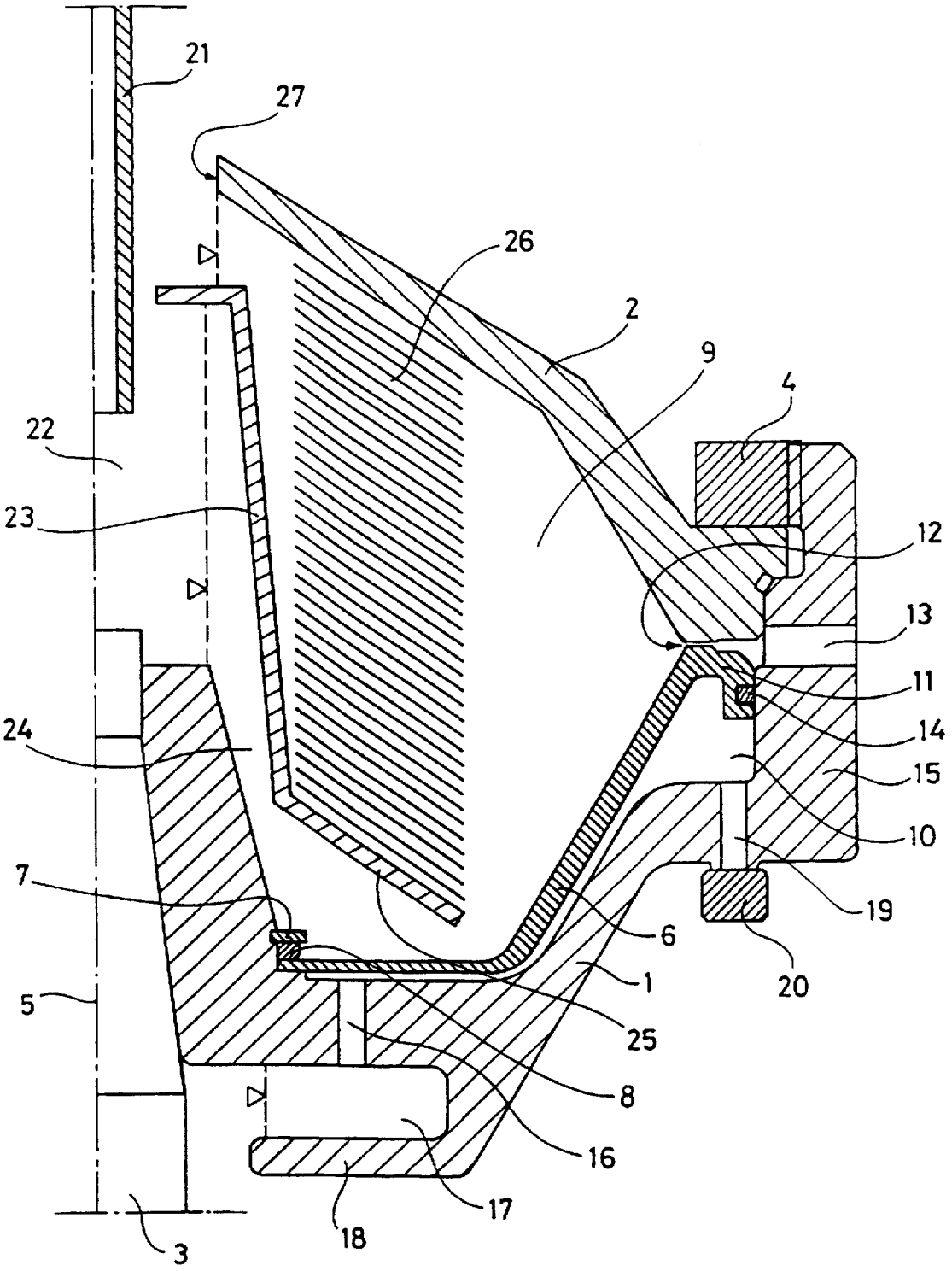
FIG. 1 shows a schematical axial section of a half centrifugal rotor according to the invention.

FIG. 1 shows a centrifugal rotor having a rotor body with a lower part 1 and an upper part 2. The lower rotor body part 1 is firmly connected with a central drive shaft 3, and the upper rotor body part 2 by means of a lock ring 4 is releasably connected with the lower rotor body part 1. By means of a driving means (not shown) the driving shaft 3 and the rotor body 1, 2 are rotatable around a centre axis 5.

Within the rotor body an annular slide 6 is connected at its radially inner edge with the lower rotor body part 1. The connection between the slide 6 and the rotor body part 1 may be of any suitable kind. In this case a fastening means is used which comprises a flat annular disc 7 that is firmly connected with a central portion of the rotor body part 1, and a ring 8 having a non-circular cross section. The ring 8 is keyed into an axial space between the disc 7 and the innermost edge portion of the slide 6 and is pressing said edge portion against a shoulder on the inside of the rotor body part 1.

The slide 6 forms within the rotor body a partition between on the one side a separation chamber 9 and, on the other side, a so called closing chamber 10.

A radially outer edge portion 11 of the slide 6 delimits a narrow slot 12 between itself and the upper rotor body part 2, which slot extends the whole way around the centre axis 5 of the rotor. Radially outside and opposite to the slot 12 the rotor body part 1 has several through channels or ports 13 distributed around the centre axis 5.

Said edge portion 11 of the slide 6 abuts through an annular gasket 14 sealingly against the inside of a radially outer cylindrical portion 15 of the lower rotor body part 1. The edge portion 11 is intended to be moved during operation of the rotor, when so is desired, axially relative to the rotor body parts 1 and 2 while sealing against the rotor body part 1, so that a communication in the form of said slot 12 can be opened intermittently between the separation chamber 9 and said ports 13.

The lower rotor body part 1 further has a number of through channels 16 extending axially from the radially inner part of the closing chamber 10 to the outside of the rotor body part 1. The channels 16 open into an annular groove 17 that is open radially inwardly and is formed by a portion 18 of the rotor body part 1.

Further, the lower rotor body part 1 has a number of through channels 19 which are distributed around the centre axis 5 and extend axially from the radially outer part of the closing chamber 10 to openings on the outside of the rotor body part 1. In the area of each one of the channel openings a valve member 20 is arranged for intermittent axial movement to or from sealing abutment against the outside of the rotor body part 1, so that the closing chamber 10 can be intermittently put in communication with the surrounding of the rotor through the channels 19. The valve members 20 as well as the equipment required for the operation of the valve members are well known to people skilled in the art, and for this reason these details are not shown or described more closely. Their shape has no significance for the present invention.

FIG. 1 further shows a stationary inlet pipe 21 for supplying a liquid mixture to be subjected to centrifugal separation into the rotor. The inlet pipe 21 opens in a central receiving chamber 22, which is surrounded by a conical partition 23 and communicates with the separation chamber 9 through passages 24 distributed around the centre axis 5. The conical partition 23 that separates the receiving chamber 22 from the separation chamber 9 is connected with the lower rotor body part 1 in a way not shown. A lower annular part 25 of the partition 23 supports in the separation chamber 9 a stack of frusto-conical separation discs 26.

Free liquid surfaces formed during operation of the centrifugal rotor in the receiving chamber 22, the separation chamber 9 and the annular groove 17 are illustrated in FIG. 1 by dotted lines and triangles.

The radially innermost portion of the upper rotor body part 2 forms an outlet from the separation chamber 9 in the form of an overflow outlet 27.

The centrifugal rotor according to FIG. 1 is intended to operate in the following manner.

After the rotor body 1, 2 has been brought into rotation around the centre axis 5 and the valve members 20 have been moved axially to their positions in which they close the channels 19, so called operating water is introduced into the groove 17. Operating water is supplied in an amount such that the groove 17 and the closing chamber 10 are filled.

Figure 2A:
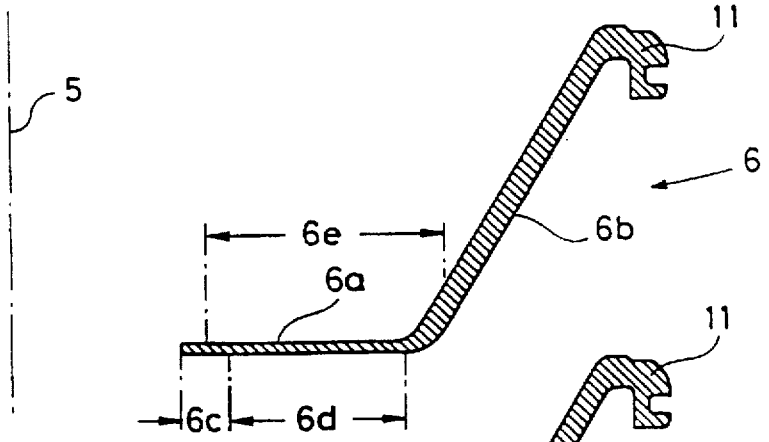
FIG. 2 illustrates in an axial section a slide according to the invention, being part of the centrifugal rotor according to FIG. 1, both in an unloaded state (FIG. 2*a*) and in a loaded state (FIG. 2*b*)
Figure 2B:
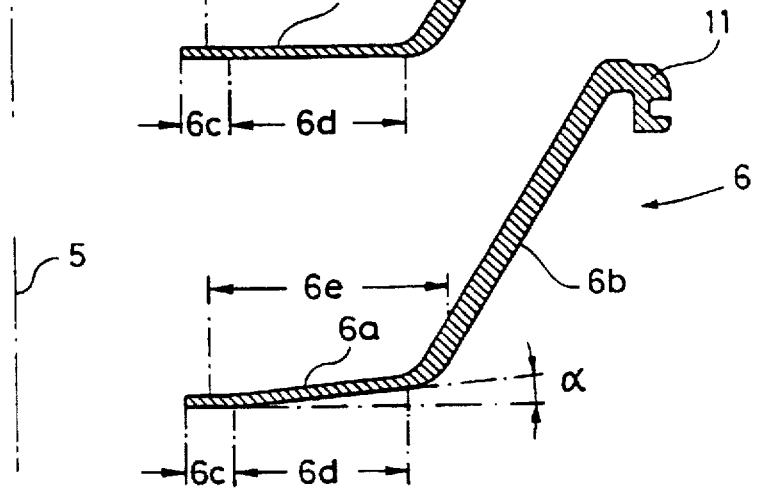

By the liquid pressure which thereby will rise in the closing chamber 10 and, thus, will act on the underside of the slide 6, the radially outer edge portion 11 of the slide will move axially to abutment against the upper rotor body part 2, so that the slot 12 disappears. This is possible in that the slide 6 in its central part is dimensioned such that an elastic deformation comes up in this part of the slide. This is explained further below with reference to FIGS. 2 and 3.

When the slide 6 in the above described way has been brought to abutment against the upper rotor body part 2, there is introduced into the separation chamber 9 through the inlet pipe 21, the receiving chamber 22 and the passages 24 a liquid mixture to be subjected to centrifugal separation. In the separation chamber a heavy component of the liquid mixture is separated from a light component thereof. The separated heavy component, e.g. solids, is collected in the radially outermost part of the separation chamber, whereas separated light component, i.e. liquid freed from particles, leaves the separation chamber through the overflow outlet 27.

Liquid mixture filling the separation chamber 9 will exert a liquid pressure onto the upper side of the slide 6, which pressure strives to recreate a slot 12 between the slide edge portion 11 and the upper rotor body part 2. As long as the closing chamber 10 is filled with operating water this will not be possible, however. This depends on the fact that the surface of the slide 6 subjected to liquid pressure is larger on the underside of the slide than on the upper side of the slide. Thus, the surface of the slide 6 facing the closing chamber 10 extends, as can be seen from FIG. 1, radially longer out than the surface of the slide 6 facing the separation chamber 9. (It is presumed that the difference as to density between the liquid mixture in the separation chamber 9 and the operating water in the closing chamber 10 is not too large and that the free liquid surfaces of the liquid mixture and the operating liquid, respectively, are situated at substantially the same radial level.)

When after some time of centrifugal separation a certain amount of separated heavy component of the liquid mixture has accumulated in the separation chamber 9, at least part of this amount has to be removed. This is done in a way such that a larger or smaller part of the operating water having been supplied to the closing chamber 10 is discharged therefrom. Thus, during a short period of time the valve members 20 are brought to uncover the openings of the channels 19, whereby a predetermined amount of operating water is discharged and the free liquid surface of the remaining operating water moves radially outwardly in the groove 17 and further through the channels 16 radially outwardly in the closing chamber 10.

At a certain position of the free liquid surface in the closing chamber 10 the pressure against the underside of the slide 6 by the operating water remaining in the closing chamber has decreased so much that the radially outer edge portion 11 of the slide 6 moves axially away from the upper rotor body part 2. This can happen, as already mentioned, as a consequence of the fact that the central part of the slide 6 is elastically deformed. Then a slot 12 is formed, whereby separated heavy component of the liquid mixture leaves the separation chamber 9.

When this happens, the free liquid surfaces in the receiving chamber 22 and the separation chamber 9 rapidly move radially outwardly, which causes the liquid pressure against the upper side of the slide 6 to decrease. After a certain movement of the liquid surfaces this liquid pressure against the upper side of the slide 6 has decreased so much that it has become smaller than the liquid pressure acting against the underside of the slide 6 by the amount of operating water maintained in the closing chamber 10 after the channels 19 have been closed.

At this stage the edge portion 11 of the slide is again moved to abutment against the upper rotor body part 2, so that the outflow through the slot 12 and the ports 13 ceases.

In the meantime, further operating water has been supplied to the groove 17 and, thereby, to the closing chamber 10, so that the edge portion 11 of the slide is safely maintained in its closing position, when further liquid mixture is supplied to the separation chamber 9.

Depending upon how much operating water that is permitted to leave through the channels 19 variously large parts of the separation chamber content, or even the whole of this content, may be discharged through the slot 12 and the ports 13.

Figure 3A:
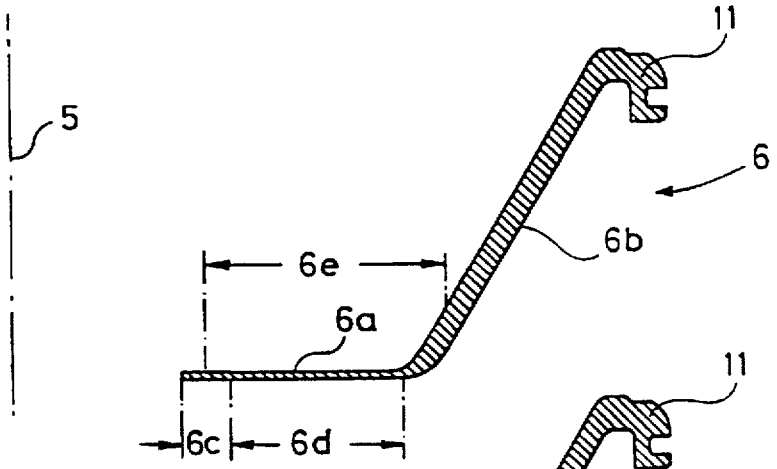
FIG. 3 illustrates a slide according to the invention formed in an alternative way both in an unloaded state (FIG. 3*a*) and in a loaded state (FIG. 3*b*).
Figure 3B:
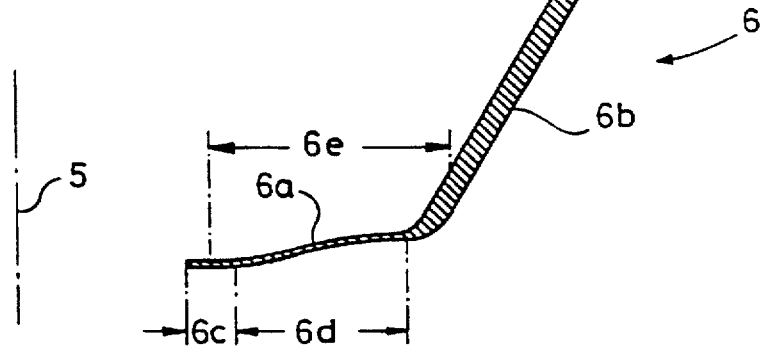

For simplifying the subsequent description of the deformability of the slide, the slide in the FIGS. 2 and 3 is divided in a centre part **6*a* and a circumferential part 6*b*. The centre part 6*a* comprises a radially inner edge portion 6*c* of the slide and an intermediate portion 6*d* of the slide. The circumferential part 6*b* comprises the previously mentioned radially outer edge portion 11 of the slide. Further, an annular area of the slide 6, in which the slide is deformable, is designated 6*e*. As can be seen, the area 6*e* covers the whole intermediate portion 6*d* and parts of the edge portion 6*c* and the circumferential part 6*b***, respectively.

In FIG. **2*a* the slide 6 is shown in an unloaded state, as it is also shown in FIG. 1. In FIG. 2*b* the slide is shown in a loaded state corresponding to that which has been described with reference to FIG. 1 when the radially outer edge portion 11 of the slide abuts axially against the upper rotor body part 2**.

When the slide 6 in FIG. 1 is loaded by a pressure on its underside from operating liquid filling the closing chamber 10, the slide is deformed such that an angle $\alpha$ comes up between the radially inner edge portion **6*c* and the intermediate portion 6*d* (FIG. 2*b*). This angle was non-existent, or nil, in the unloaded state of the slide. Another angular change coming up in the area 6*e* concerns the angle formed between the circumferential part 6*b* and the intermediate portion 6*d*. This angle will be larger, as can be seen, when the slide 6** is loaded in the above described manner.

The deformation of the slide 6 described here is in reality extremely small and has, for the sake of clarity, been exaggerated in FIG. **2*b*. The deformation is, therefore, an elastic deformation, for which reason the slide 6 will automatically retain its original form (according to FIG. 2*a***) if the load ceases.

In practical operation of a centrifugal rotor of the kind shown in FIG. 1 the deformation of the slide 6 will be governed completely by the hydraulic pressures which are created at different times in the separation chamber 9 and in the closing chamber 10. Therefore, at least in connection with a partial discharge of the content of the separation chamber 9 through the slot 12, the edge portion 11 of the slide 6 will never reach an end position at its movement downwardly with reference to FIG. 1 as a result of the slide being deformed into contact with the lower rotor body part 1. However, it is suitable that support members are arranged at suitable places for such a contact, so that the slide is not by mistake, or in connection with a total discharge of the content of the separation chamber 9 through the slot 12, plastically deformed in the area **6*e*** and, thus, becomes permanently deformed.

In the embodiment of a centrifugal separator according to the invention shown in FIG. 1 the slide 6 is mounted such that the slot 12 is obtained when the slide 6 is in an unloaded state. Alternatively, however, the slide 6 may be mounted such in the centrifugal rotor that its edge portion 11, by a larger or smaller force, abuts against the upper rotor body part 2 without being influenced by hydraulic forces. If desired the slide may be mounted such that it abuts with a certain predetermined pretension against the rotor body part 2. The pretension may be accomplished either by the slide abutting against the rotor body part 2 in an elastically deformed state or by means of separate spring members acting on the slide. Thereby, the requirement of pressure from the operating liquid in the closing chamber 10 to keep the peripheral outlets of the separation chamber 9 closed is decreased, and both the slide 6 and the closing chamber 10 may in such a case be given a reduced radial extension outside the radial level of the area, in which the slide edge portion 11 is intended to abut against the upper rotor body part 2. Thereby, the rotor body 1, 2 can be given a somewhat reduced radius.

The slide 6 shown in FIGS. **2*a* and 2*b* has been assumed to be firmly connected with a rotor body along the whole of the radial extension of the inner edge portion 6*c*. Deformation of the slide in this edge portion 6*c*** therefore has not been possible.

It is true that the slide 6 shown in FIG. **3*a* and 3*b* is also supposed to be axially fixed relative to a rotor body in the area of the inner edge portion 6c, but in this case the fixation is such that the edge portion 6c is allowed to flex somewhat and, thus, a certain axial movability relative to the rotor body is allowed for the radially most inner part of the edge portion 6c**.

This circumstance makes that the slide 6 in the annular area 6e will be deformed in a different way than a slide that is fixed at a rotor body in the way presumed according to FIG. 2a and 2b. As can be seen from FIG. 3b the angular change will here occur above all between different parts of the intermediate portions 6d of the slide, situated at different distances from the centre axis 5.

In both of the cases illustrated in FIG. 2 and FIG. 3 the circumferential part 6b of the slide is dimensioned such that it will not be deformed, when the radially outer edge portion 11 is moved axially relative to the radially inner edge portion 6c. Therefore, no difficulty will be encountered with the sealing that is to be accomplished by means of the gasket 14 (FIG. 1).

Further, the slide 6 in the area 6e is very strong in the radial direction, despite that different concentrical parts of the slide may move axially in relation to each other. This depends on the fact that the actual deformation zones, which have been created in the slide by its dimensioning, have been given a relatively large radial extension and been localized to parts of the slide which extend substantially radially.

The slide according to the invention is formed in one single piece of one and the same material, e.g. steel of a suitable quality. As one and the same material is meant in this connection even a material containing a reinforcement of one kind or another, such as glass or carbon fibre reinforced plastic. Even if the reinforcement is not evenly distributed in the whole slide, a slide composed in this way is considered to be comprised by the invention.

As to the feature of the invention that an angular change shall come up between parts of the slide which are situated at different distances from the centre axis of the slide and the centrifugal rotor, it is hereby not necessarily meant adjacent parts of the slide. In the embodiment according to FIG. 3 the slide, thus, is adapted to be bent gradually, seen in an axial section through the slide, along a relatively large radial extension thereof. In this case the angular change between adjacent parts of the slide will be practically nil, whereas parts of the slide situated at a certain radial distance from each other will undergo a more evident angular change in relation to each other.

It should be noticed that the deformation of a slide according to the invention, relevant in this connection, is normally very small. Thus, the width of the formed slot 12 may be limited to only 1 mm in connection with an annular slide, the inner and outer edge portions of which have diameters in the order of 100 mm and 600 mm, respectively. The size of the slot may, however, be larger or smaller than 1 mm, if desired, independent of the size of the slide.

The invention has been described above in connection with a slide formed for opening and closing of a peripheral outlet from the separation chamber in a centrifugal rotor. In centrifugal rotors slides are also used for other purposes, e.g. for opening and closing of passages for operating water. Slides of this kind are not included in the centrifugal rotor according to FIG. 1, which is of a very simple kind and also very schematically shown. However, such slides are very common in connection with other kinds of centrifugal separators, and the present invention may be used even in connection with such slides.

What is claimed is:

1. A slide comprising a center part (6a) and a circumferential part (6b) surrounding the center part, and being formed in a single piece with and of the same material as the center part, said slide being formed for mounting in a rotor of a centrifugal separator having a rotational axis for rotation therewith and having said circumferential part (6b) extending around a center axis (5) coinciding with the rotational axis of the rotor, at least an annular portion (11) of said circumferential part (6b) of the slide being axially movable from a first position to a second position relative to at least a portion (6c) of said center part (6a) upon resilient deformation of the slide in an annular area (6e) concentrical with said center axis (5), wherein said annular area (6e) has a radial extension such that, upon said resilient deformation of the slide, an angular change ($\alpha$) will occur—seen in an axial section through the slide—between portions (6c, 6d) of the slide situated at different distances from said center axis (5).

2. The slide according to claim 1, in which said annular area (6e) has a substantial radial extension in relation to the total radial extension of the slide and the slide is adapted to be bent gradually along said radial extension, seen in said axial section.

3. The slide according to claim 1, which is annular.

4. A centrifugal rotor having a separation chamber (9) and comprising a rotor body (1, 2) having a center axis (5), around which said rotor is rotatable, and a slide (6) that is arranged for rotation together with the rotor body (1, 2) and that comprises a center part (6a), through the center of which said center axis (5) extends, and a circumferential part (6b) surrounding said center part and being formed in one single piece with and of the same material as the center part, at least an annular portion (11) of the circumferential part (6b) being axially movable during rotation of the rotor from a first position to a second position relative to at least a portion (6c) of said center part (6a) upon resilient deformation of the slide in an annular area (6e) concentric with said center axis (5), wherein said annular area (6e) has a radial extension such that upon said resilient deformation of the slide an angular change occurs—seen in an axial section through the slide—between portions (6c, 6d) of the slide situated at different distances from said center axis (5).

5. The centrifugal rotor according to claim 4, in which said annular area (6e) has a substantial radial extension in relation to the total radial extension of the slide and the slide is adapted to be bent gradually along said radial extension, seen in said axial section.

6. The centrifugal rotor according to claim 4, in which the slide is annular.

7. The centrifugal rotor according to claim 4, in which the center part (6a) of the slide is axially fixed relative to the rotor body (1, 2), and a radially outer edge portion (11) of the slide is axially movable relative to the rotor body (1, 2).

8. The centrifugal rotor according to claim 7, in which the slide is adapted to cooperate by said radially outer edge portion (11) with the rotor body for intermittent uncovering of at least one peripheral outlet opening (12, 13) from the separation chamber (9).

9. The centrifugal rotor according to claim 8, in which the slide forms a partition in the rotor body between the separation chamber (9) and an operating liquid chamber (10), said operating liquid chamber having at least one inlet (16–18) and at least one outlet (19, 20) for an operating liquid.

* * * * *